US009199784B2

(12) United States Patent
Caruso

(10) Patent No.: US 9,199,784 B2
(45) Date of Patent: Dec. 1, 2015

(54) SPRING-BIASED FLIP TOP CASE FOR AN AEROSOL CANISTER

(71) Applicant: The GPM Group, LLC, Tonawanda, NY (US)

(72) Inventor: Albert P. Caruso, Tonawanda, NY (US)

(73) Assignee: Avanti U.S.A. Ltd., Tonawanda, NY (US)

( * ) Notice: Subject to any disclaimer, the term of this patent is extended or adjusted under 35 U.S.C. 154(b) by 94 days.

(21) Appl. No.: 14/047,475

(22) Filed: Oct. 7, 2013

(65) Prior Publication Data

US 2015/0097004 A1 Apr. 9, 2015

(51) Int. Cl.
*F16F 1/06* (2006.01)
*B65D 83/56* (2006.01)
*B65D 83/38* (2006.01)

(52) U.S. Cl.
CPC ..... *B65D 83/56* (2013.01); *B65D 83/384* (2013.01)

(58) Field of Classification Search
CPC ..... B65D 83/201–83/206; B65D 83/425
USPC ..... 267/158–161, 180, 182; 222/153.02, 222/153.07, 153.11, 402.11
See application file for complete search history.

(56) References Cited

U.S. PATENT DOCUMENTS

| | | | | |
|---|---|---|---|---|
| 2,837,375 | A | | 6/1958 | Efford et al. |
| 2,951,646 | A | | 9/1960 | Efford et al. |
| 3,083,882 | A | | 4/1963 | Schmid et al. |
| 3,178,071 | A | | 4/1965 | Gentoso |
| 3,452,906 | A | | 7/1969 | Daniels |
| 3,491,951 | A | | 1/1970 | Knibb |
| 3,847,423 | A | * | 11/1974 | Gley ..... 292/113 |
| 4,251,032 | A | | 2/1981 | Werding |
| 4,325,497 | A | | 4/1982 | Ewald |
| 4,333,589 | A | | 6/1982 | Bush |
| 4,442,955 | A | * | 4/1984 | Bush ..... 222/153.02 |
| 4,477,001 | A | | 10/1984 | Galia |
| 5,303,853 | A | | 4/1994 | Nye |
| 5,348,193 | A | | 9/1994 | Bruckner et al. |
| 5,517,180 | A | | 5/1996 | Masi et al. |
| 5,553,467 | A | * | 9/1996 | Calabro ..... 63/14.5 |
| 5,644,297 | A | | 7/1997 | Masi et al. |
| 5,769,283 | A | | 6/1998 | Owada et al. |
| 5,897,026 | A | | 4/1999 | Vester et al. |
| 5,949,338 | A | | 9/1999 | Masi et al. |
| 7,121,432 | B2 | | 10/2006 | Kostal et al. |
| 7,121,434 | B1 | | 10/2006 | Caruso |
| 2007/0073221 | A1 | * | 3/2007 | Bialecki et al. ..... 604/110 |
| 2010/0155427 | A1 | | 6/2010 | Lilienthal et al. |
| 2011/0006083 | A1 | | 1/2011 | Walters et al. |
| 2011/0036414 | A1 | | 2/2011 | Paauwe |
| 2011/0210146 | A1 | | 9/2011 | Dapper |

FOREIGN PATENT DOCUMENTS

| | | | |
|---|---|---|---|
| EP | 1338530 | A1 | 8/2003 |
| JP | 2008254751 | A | 10/2008 |

* cited by examiner

*Primary Examiner* — Christopher Schwartz
(74) *Attorney, Agent, or Firm* — Simpson & Simpson, PLLC

(57) ABSTRACT

A spring mechanism comprising a spring element having a pair of arms separated by a gap, a tapered flexible tongue with an enlarged tip, and a tapered slot extending longitudinally through the tongue, wherein the tapered flexible tongue is operatively arranged to bend such that the tip enters the gap and engages the pair of arms. A case for a canister capable of dispelling material is also disclosed using the spring mechanism to bias a lid in a closed position.

13 Claims, 15 Drawing Sheets

SPRING-BIASED FLIP TOP CASE FOR AN AEROSOL CANISTER

FIELD OF THE INVENTION

The invention relates generally to a case for an aerosol canister, and, more specifically, to a flip top case for an aerosol canister and, even more specifically, to a spring mechanism for a flip top case for an aerosol canister.

BACKGROUND

Cases for aerosol or spray canisters typically include an actuator to engage the stem of the canister in order to dispel the canister's contents. There are a variety of aerosol dispensers that are used in many applications which include dispensing perfume, air fresheners, personal hygiene products, covering an article with a coat of paint, and dispensing cleaning products, amongst others. One specific application for an aerosol dispenser is as a personal defense device that, for example, directs a chemical repellant spray towards a potential human or animal threat.

Typical lids for dispensing actuators or cases for aerosol and spray canisters are intended to either prevent accidental discharge or provide easy dispensing. With respect to personal defense devices, easy dispensing is crucial to ensure the safety of the user when a threat presents itself. However, the reason personal defense devices are effective is because their chemical contents are indiscriminately extremely painful to anyone who comes into contact with it.

U.S. Patent Application Publication No. 2011/0006083 discloses a dispensing actuator for use on a container having pressurized contents configured for convenient one-handed manipulation and use. The dispensing actuator includes a hingedly moveable flip-open lid, and a laterally moveable button, which can be manipulated so that the button cooperates with the lid to move the lid from a closed position to an opened position. The dispensing actuator in this application further includes an inner, downwardly deflectable actuating element, operatively connected with a dispensing valve of the associated container. Resilient, downward deflection of the actuating element, after opening of the dispensing actuator lid, permits the contents of the container to be conveniently dispensed. Unfortunately, this dispensing actuator requires various movements by the user to spray the contents of the container and return the dispensing actuator to its original position. Pressing the button to open the lid, accurately positioning the user's finger over the actuator, depressing the actuator and then manually closing the lid is cumbersome, time consuming, and possibly dangerous in that the potential victim might not activate the device in time to thwart the threat.

U.S. Pat. No. 5,348,193 describes a case suitable for an aerosol dispenser being used as a personal defense device. The case is described as having a body with a moveable top protective flap to prevent accidental discharge of an aerosol can. The flap uses a spring disposed about a hinge for holding the flap in the closed position. The flap is described as being installed on the case by spreading (i.e., flexing) the material used to make the body of the case in the region of the hinge with a spread tool sufficiently so that the flap may be inserted into the hinge and then allowing the material to substantially return to its original shape. However, this process requires that the installation of the flap be performed soon after molding the case so that the body is sufficiently pliable. Unfortunately, if the flap dislodges from the hinge, the case is then useless to prevent accidental discharge of the chemical because the flap cannot be reassembled after the manufacturing process of the case.

Therefore, there is a long-felt need for an improved case for an aerosol or spray canister that minimizes the number of movements to dispel the canister's contents under pressure. There is also a long-felt need for a case that is simple to reassemble if it breaks. Further, there is also a long-felt need for a spring mechanism used in a flip top case that can be made of plastic in order to minimize manufacturing costs.

SUMMARY

The present invention comprises a spring mechanism comprising a spring element having a pair of arms separated by a gap, a tapered flexible tongue with an enlarged tip, and a tapered slot extending longitudinally through the tongue, wherein the tapered flexible tongue is operatively arranged to bend such that the tip enters the gap and engages the pair of arms.

The present invention also comprises a case for a canister capable of dispelling material comprising a main body to house the canister, the main body having a front aperture, a top lid to cover the main body, a spring non-rotatably secured to the main body and rotatably secured to the top lid, the spring comprising a tapered flexible tongue with an enlarged tip, and a tapered slot extending longitudinally through the tongue, and an actuator to direct dispelled material from the canister out of the main body through the front aperture.

A general object of the present invention is to provide a case with a flip top that minimizes the number of movements required to dispel the contents of the canister.

Another object of the present invention is to provide a spring mechanism to be used in a case with a flip top that can be manufactured out of plastic.

These and other objects, advantages and features of the present invention will be better appreciated by those having ordinary skill in the art in view of the following detailed description of the invention in view of the drawings.

BRIEF DESCRIPTION OF THE DRAWINGS

The nature and mode of operation of the present invention will now be more fully described in the following detailed description of the invention taken with the accompanying figures, in which.

DETAILED DESCRIPTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1A:
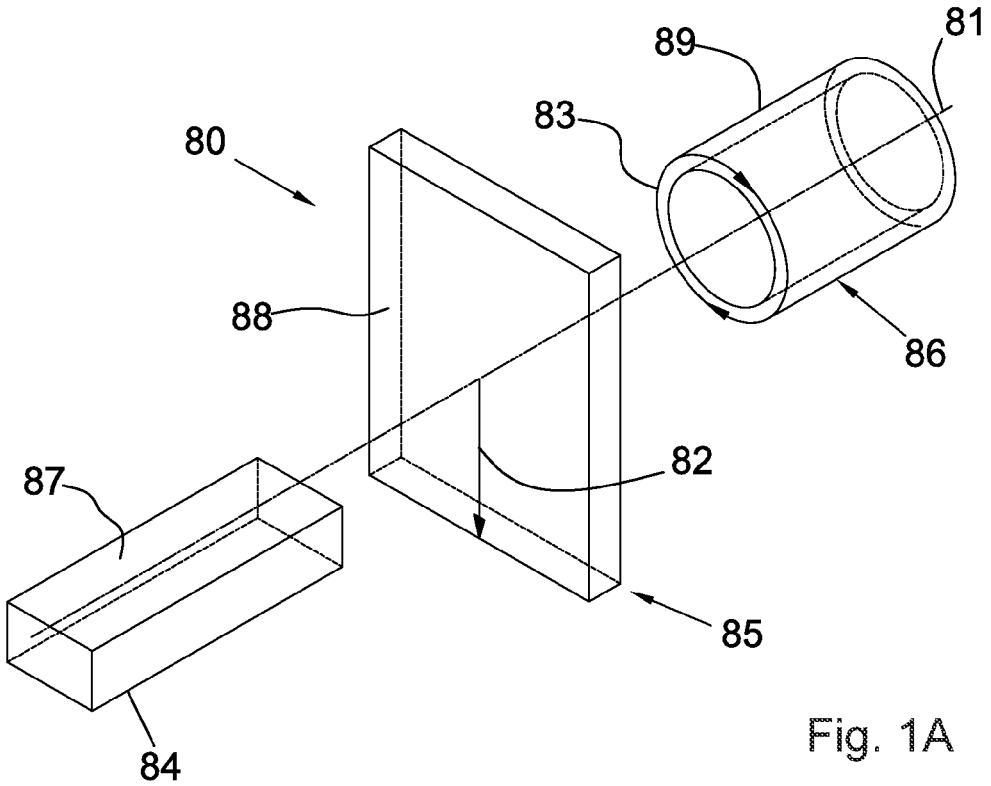
FIG. 1A is a perspective view of a cylindrical coordinate system demonstrating spatial terminology used to describe the invention.

FIG. 1A is a perspective view of cylindrical coordinate system 80 demonstrating spatial terminology used in the present application. The present invention is at least partially described within the context of a cylindrical coordinate system. System 80 has a longitudinal axis 81, used as the reference for the directional and spatial terms that follow. The adjectives "axial," "radial," and "circumferential" refer to an orientation parallel to axis 81, radius 82 (which is orthogonal to axis 81), and circumference 83, respectively. The adjectives "axial," "radial" and "circumferential" also refer to an orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" refer to an orientation parallel to axis 81, radius 82, or circumference 83, respectively. The adverbs "axially," "radially," and "circumferentially" refer to an orientation parallel to respective planes.

Figure 1B:
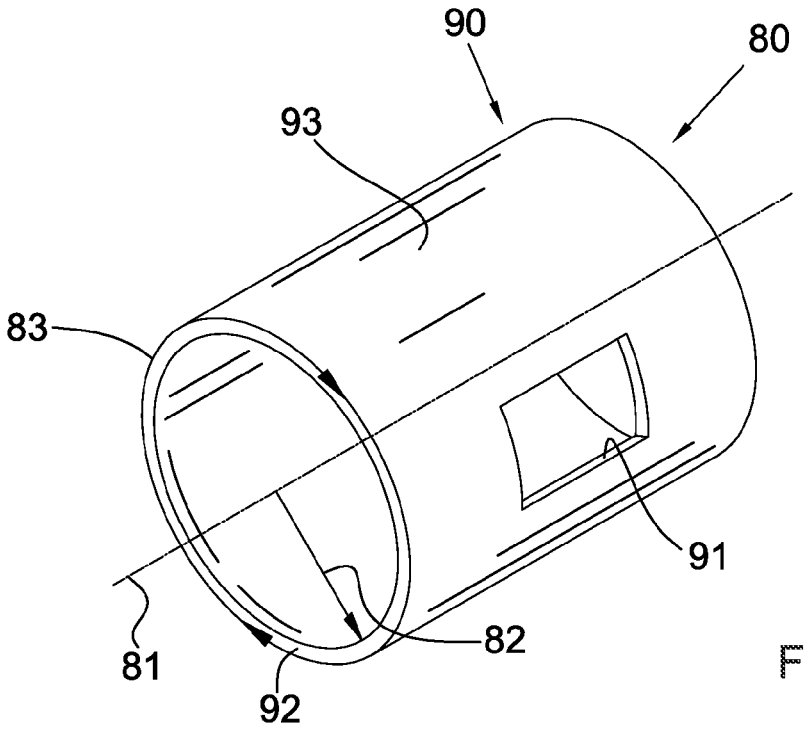
FIG. 1B is a perspective view of an object in the cylindrical coordinate system of FIG. 1A demonstrating spatial terminology used to describe the invention.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2:
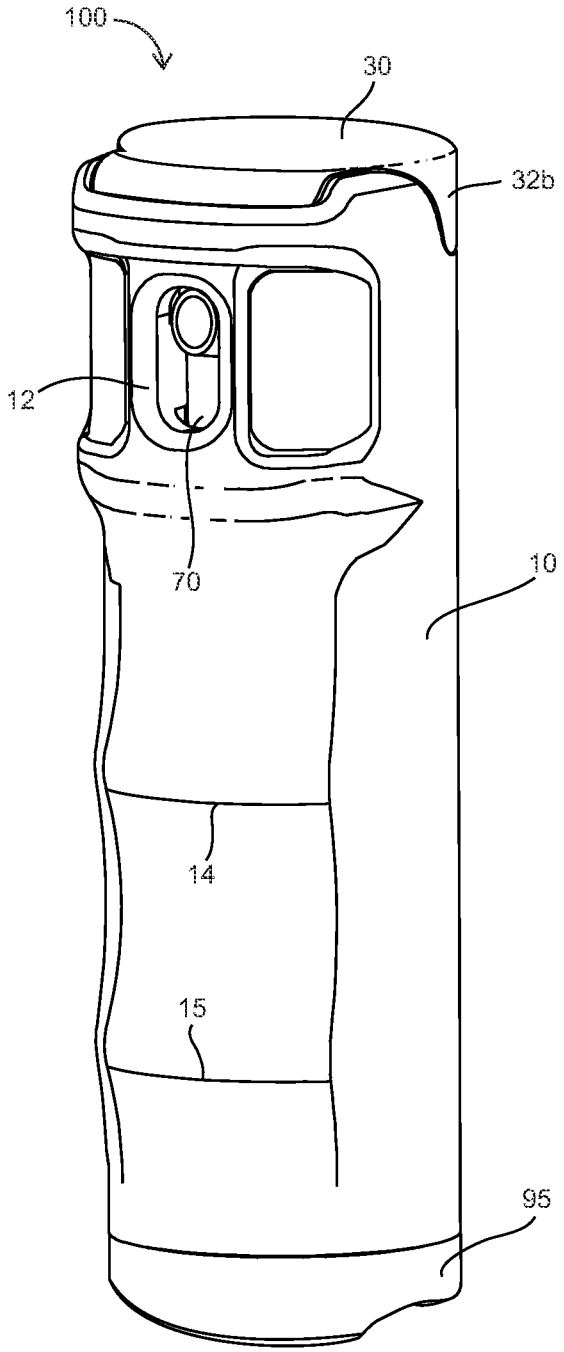
FIG. 2 is a front perspective view of a preferred embodiment of the present invention.

FIG. 2 is a front perspective view of case 100 of the present invention. Case 100 generally comprises main body 10, actuator 70, top lid 30, bottom cap 95, and spring element 50 (shown in FIG. 6) connecting lid 30 with main body 10. Case 100 and its constituents are preferably made out of molded plastic, however any material such as metal, rubber, elastomeric material, or a combination of any materials among its constituent parts may be used as appreciated by a person having ordinary skill in the art.

Main body 10 is cylindrical in nature and is adapted to enclose a canister containing a substance under pressure. In a preferred embodiment, case 100 is dimensioned with an axial length and a radius to engage a canister of pepper spray. However, it should be understood that case 100 may be manufactured with any combination of axial lengths and radii dictated by the type of canister that case 100 is to encompass.

Still referring to FIG. 2, main body 10 has circumferential aperture 12 to enable nozzle 72 (labeled in FIG. 10) of actuator 70 to direct any dispelled material outward through case 100. Aperture 12 is slightly elongated in the axial direction to accommodate the upward and downward movement of nozzle 72 when a user depresses actuator 70 to actuate the expulsion of the material within the canister and then releases actuator 70 to cease the expulsion of material. Further, finger ridges 14 and 15 are molded into main body 10 in order to create a better grip for the user and to increase the user's comfort while gripping case 100.

Figure 3:
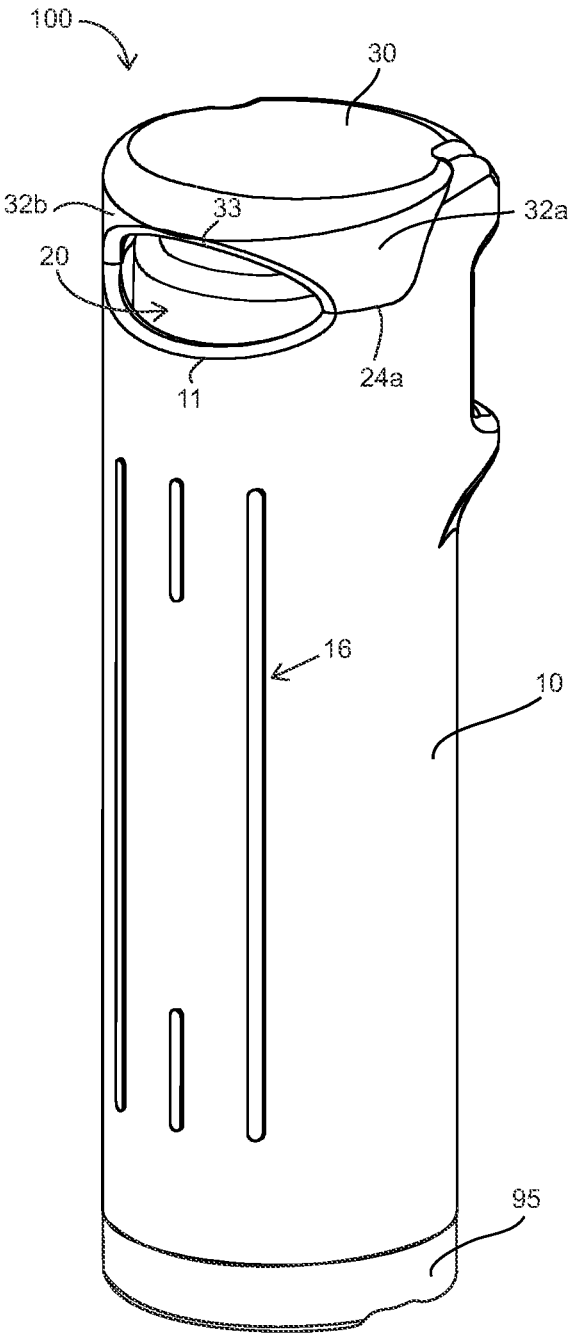
FIG. 3 is a rear perspective view of a preferred embodiment of the present invention.

FIG. 3 is a rear perspective view of case 100. Protruding axial grips 16 are molded onto the rear of main body 10 in order to engage the user's palm and to further increase the user's grip while holding case 100. Rear opening 20 is generally ellipsoidal in shape with its top arcuate curve defined by the rear of lid 30 and its bottom arcuate curve defined by the rear of main body 10. Lateral lid wings 32*a* and 32*b* of lid 30 are shaped to extend axially downward to engage main body 10 and create interface 24 such that lid 30 disengages main body 10 at the vertices of the transverse diameter of rear opening 20.

Figure 4:
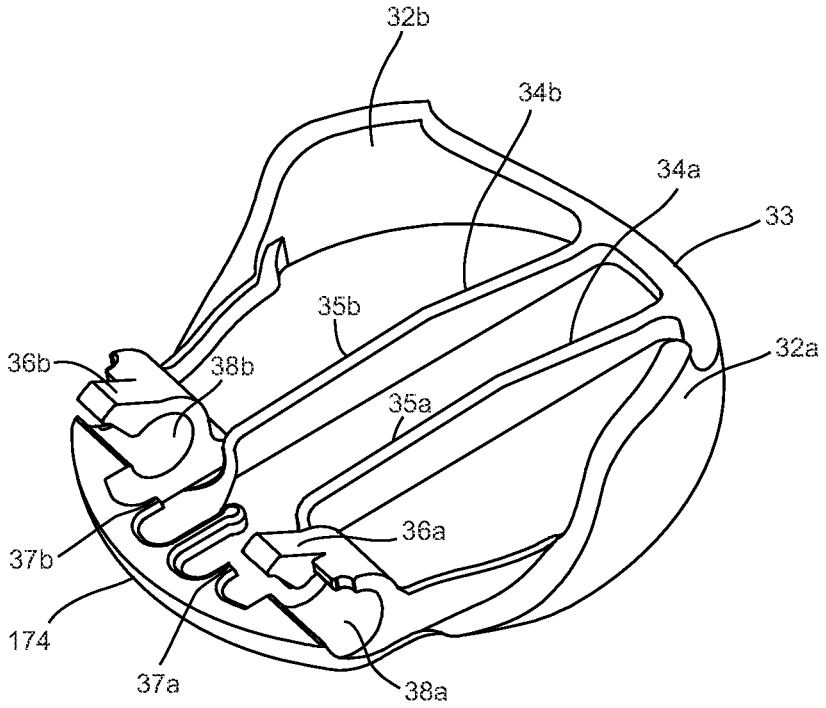
FIG. 4 is a bottom perspective view of the lid of the case of the present invention.

FIG. 4 shows the bottom of lid 30. Lateral wings 32*a* and 32*b* rest on top of the rear of main body 10 (shown in FIG. 2), and curved receptacles 38*a* and 38*b* rotatingly engage spring 50 (shown in FIG. 6) near the front of main body 10. Lid tabs 36*a* and 36*b* create a mechanical stop with their respective apices 166*a* and 166*b* (best illustrated in FIGS. 14A and 14B) of main body 10. The bottom of lid 30 also has rear sloped guides 34*a* and 34*b* contiguous with their respective horizontal guides 35*a* and 35*b*. The guides facilitate the insertion of the user's finger or thumb into rear opening 20 (shown in FIG. 3), as will be described further with respect to FIGS. 5A-5C.

Figure 5A:
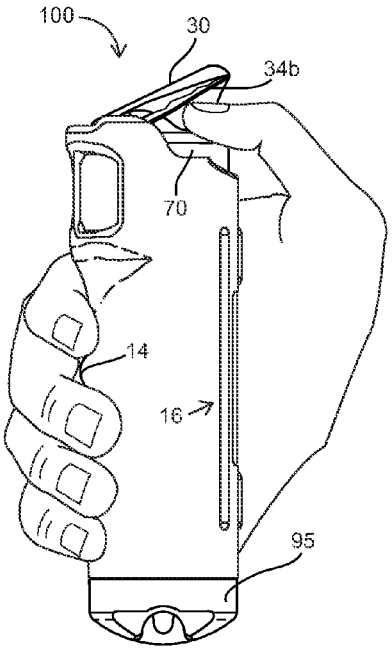
FIG. 5A illustrates an embodiment of the present invention being used with a thumb partially inserted into the rear opening.
Figure 5B:
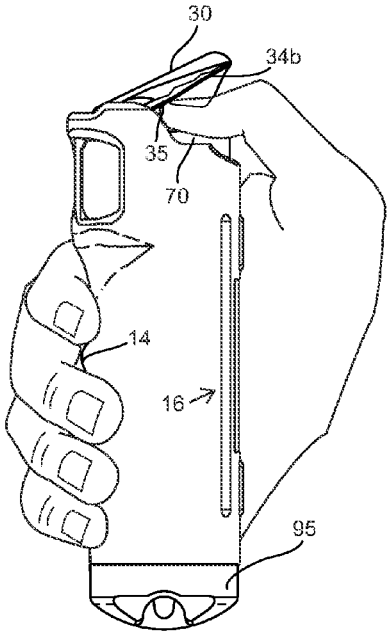
FIG. 5B illustrates an embodiment of the present invention being used with a thumb fully inserted into the rear opening.
Figure 5C:
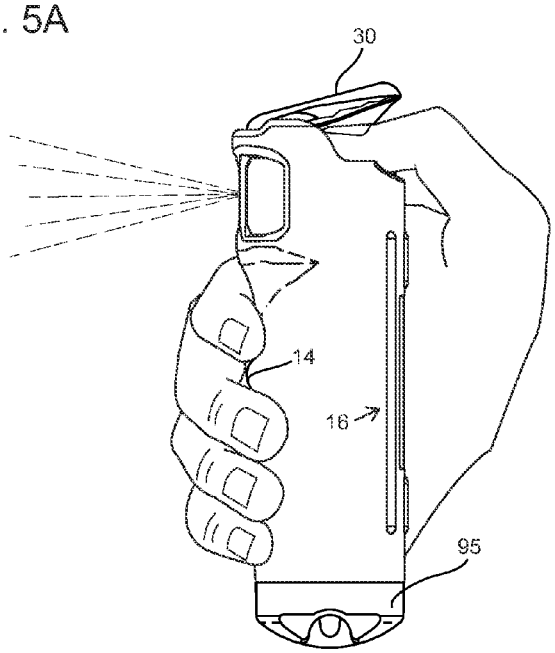
FIG. 5C illustrates an embodiment of the present invention being used with a thumb fully inserted into the rear opening and depressing the actuator.

FIGS. 5A-5C illustrate a canister housed within case 100 and in the process of being used by a user. The left lateral lid wing has been removed from lid 30 in FIGS. 5A-5C in order to better illustrate the user's thumb position. The user is shown holding case 100 with his or her index finger above finger ridge 14, his or her middle finger below finger ridge 14 and his or her palm proximate to axial grips 16. To dispel the contents of the canister, the user inserts his or her thumb into the rear opening and depresses actuator 70.

FIG. 5A illustrates the user initially inserting his or her thumb into the rear opening. While the user's thumb is partially inserted into the rear opening, the tip of the user's thumb slides along the rear sloped guides 34*a* (shown in FIGS. 4) and 34*b*. Lid 30 is biased toward its closed position (shown in FIGS. 2 and 3) by spring 50 (FIG. 6) so the user is opposing this force initially in order to open the lid. Sloped guides 34*a* and 34*b* are configured to facilitate the rotation of lid 30 as well as to guide the user's thumb into a central position over actuator 70. With the sloped guides 34*a* and 34*b* aiding in the rotation of lid 30, the user can use a single substantially linear radial motion to insert his or her thumb. A single substantially radial motion, as opposed to requiring a prior and separate axial motion to lift the lid, decreases the possibility for the user to fumble while trying to depress actuator 70. This may become especially important when the canister housed in case 100 contains pepper spray and the user is presented with a threat.

FIG. 5B illustrates the user with his or her thumb in a central position over actuator 70. In this position, the tip of the user's thumb engages horizontal guides 35*a* (shown in FIGS. 4) and 35*b*. The user is now in a position to depress actuator 70.

FIG. 5C illustrates the user depressing actuator 70 (visible in FIGS. 5A and 5B). In this position, horizontal guides 35*a* (shown in FIGS. 4) and 35*b* generally rest on top of the user's thumb nail and may provide some downward force because lid 30 is biased in the closed position. While the user is depressing the actuator in the axial direction, finger ridges 14 and 15 (shown in FIG. 2) help prevent main body 10 from slipping in the axial direction in the user's hand. FIG. 5C shows material being dispelled from the canister represented by dotted lines.

Figure 6:
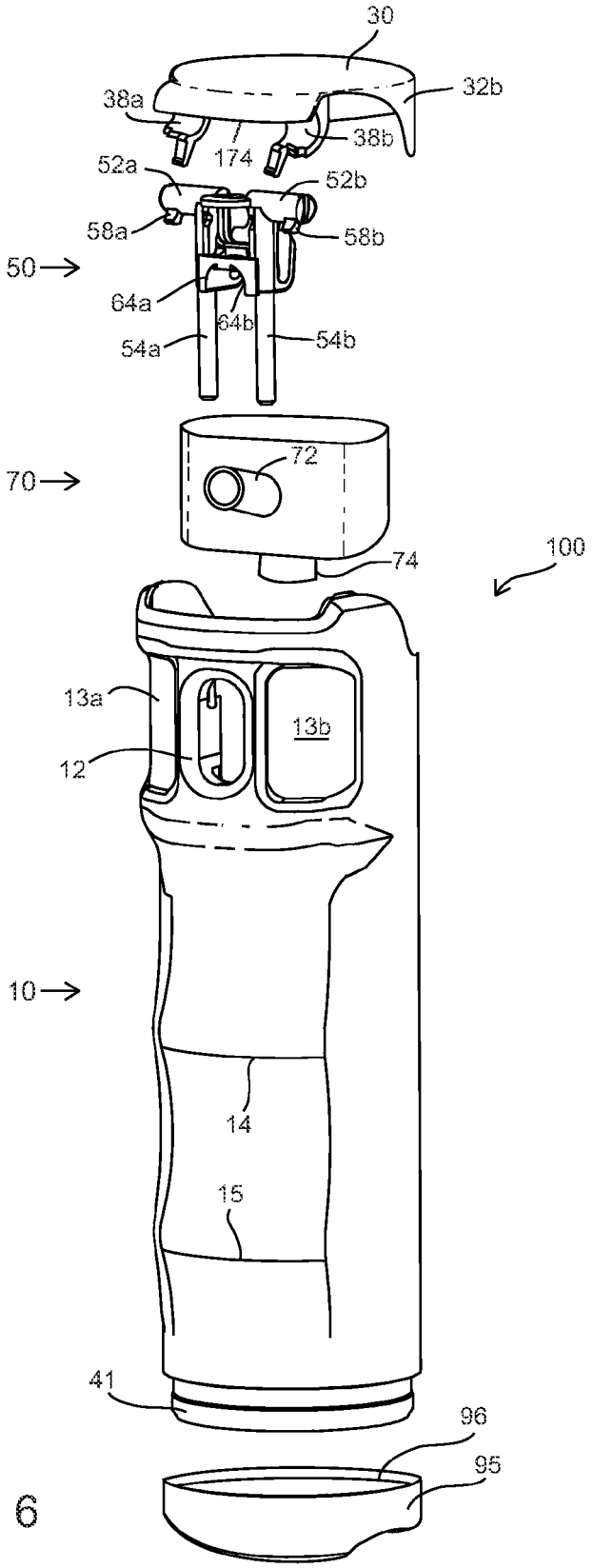
FIG. 6 is an exploded view of the embodiment shown in FIG. 2.

FIG. 6 is an exploded view of case 100. A canister (not shown) is inserted axially upwards through the bottom of main body 10. Bottom cap 95 is then attached to main body 10 in order to prevent the canister from falling out. Bottom cap 95 is secured to main body 10 by circumferential lip 96 engaging circumferential rim 41 of main body 10. Actuator 10 is inserted axially downwards through the top of main body 10 and engages the stem of the canister via receiving port 74. Nozzle 72 directs the discharged contents of the canister through circumferential aperture 12 of main body 10.

Still referring to FIG. 6, spring 50 is attached to lid 30 by inserting spring arms 52*a* and 52*b* into curved receptacles 38*a* and 38*b*, respectively. Lid 30 is rotatable because curved receptacle 38*a* is rotatable around arm 52*a* and curved receptacle 38*b* is rotatable around arm 52*b*. When lid 30 is rotated to a certain extent, tabs 58*a* and 58*b* abut front edge 174 of lid 30, thereby limiting rotation between spring 50 and lid 30. Spring 50 is attached to main body 10 by inserting legs 54*a* and 54*b* into engagement mechanisms located inside main body 10 proximate to indents 13*a* and 13*b*. Spring 50 is inserted into the main body engagement mechanisms with nozzle 72 of actuator 70 between spring legs 54*a* and 54*b*. Spring 50 has curved surfaces 64*a* and 64*b* to accommodate nozzle 72. Finally, lateral wings 32*a* (shown in FIGS. 3) and 32*b* rest atop the rear portion of main body 10.

Generally, with reference to FIGS. 7A-7H, spring element 50 comprises arms 52*a* and 52*b*, legs 54*a* and 54*b*, and tongue 56. Preferably, arms 52*a* and 52*b* are horizontal and colinear with each other while legs 54*a* and 54*b* are parallel to each other and run vertically in the axial direction when inserted into main body 10 (shown in FIG. 6). Arm 52*b* has vertical slot 57*b*, and arm 52*a* has an analogous vertical slot (not shown). Slot 57*b* and its analogous vertical slot on arm 52*a* engages rail 157*b* and 157*a* (shown in FIG. 9A), respectively, on the inside of main body 10. Slot 57*b* and its analogous slot on arm 52*a* ensure that spring 50 is properly inserted into main body 10 as well as provide stability to arms 52*a* and 52*b* while lid 30 (shown in FIG. 2) is rotating. Arms 52*a* and 52*b* are separated by gap 52*c*.

Tongue 56 is flexible and provides a biasing torque against lid 30 (shown in FIG. 6) into a closed position while arms 52*a* and 52*b* are rigid and provide stability within main body 10 (also shown in FIG. 6). The geometry of tongue 56 enables spring element 50 to be manufactured out of plastic instead of metal requiring an appropriate yield strength that is typically used in spring mechanisms. Tongue 56 has a tapered shaft with an enlarged tip so that tongue 56 yields, or bends, more easily at its shaft. Further, a slot runs longitudinally through tongue 56 and is also tapered to reflect the shape of tongue 56. The slot enables tongue 56 to bend with the appropriate spring constant for the desired required force.

Figure 7A:
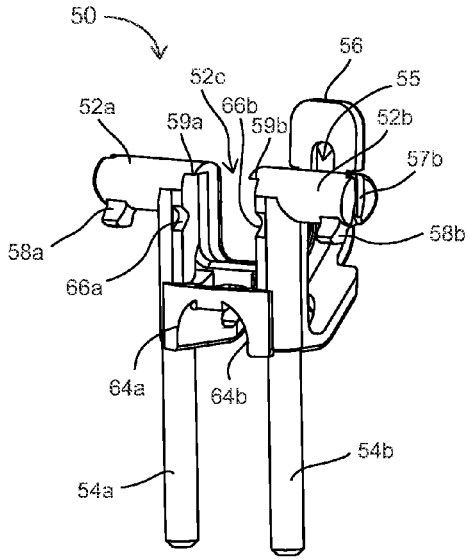
FIG. 7A is a front perspective view of the uncocked spring element.

FIG. 7A is a front perspective view of spring 50 in an uncocked, or "rest", position meaning that no mechanical energy is stored. Leg grooves 66*a* and 66*b* are near the top of legs 54*a* and 54*b*, respectively, proximate to arms 52*a* and 52*b*, respectively. Leg grooves 66*a* and 66*b* provide another mechanical stop for when lid 30 (shown in FIG. 6) rotates by engaging nibs 37*a* and 37*b* (shown in FIG. 4), respectively. The first mechanical stop described above is tabs 58*a* and 58*b* engaging front edge 174 of lid 30, thereby limiting rotation between spring 50 and lid 30. Further, arms 52*a* and 52*b* have overhangs 59*a* and 59*b*, respectively. Overhangs 59*a* and 59*b* are simply the result of substantially rectangular grooves on the interior lateral portions of arms 52*a* and 52*b*, and will be explained in further detail with respect to FIG. 7C. As described above with respect to FIG. 6, spring 50 has curved surfaces 64*a* and 64*b* to accommodate nozzle 72.

Figure 7B:
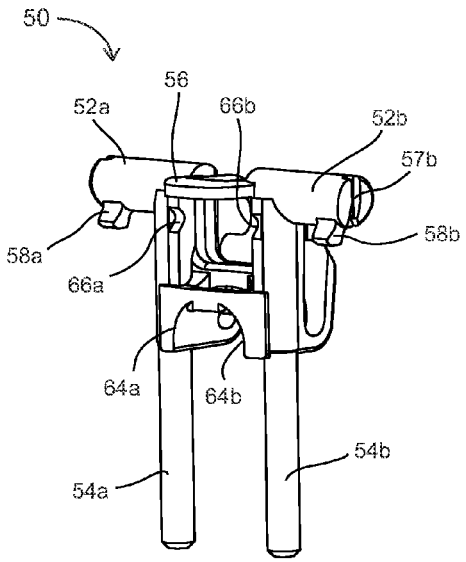
FIG. 7B is a front perspective view of the cocked spring element.

FIG. 7B is a front perspective view of spring 50 in a cocked position. In this position, the shaft of tongue 56 is bent and the tip of tongue 56 is configured between colinear arms 52*a* and 52*b*. The tapered shaft and tapered slot 55 of tongue 56 enable tongue 56 to be fitted between arms 52*a* and 52*b* by being narrower than the gap between arms 52*a* and 52*b*. Further, the shaft of tongue 56 may be forcibly squeezed narrower if needed to fit between arms 52*a* and 52*b*. In a preferred embodiment, tongue 56 is held in the cocked position, which will be described in more detail with respect to FIG. 7C.

Figure 7C:
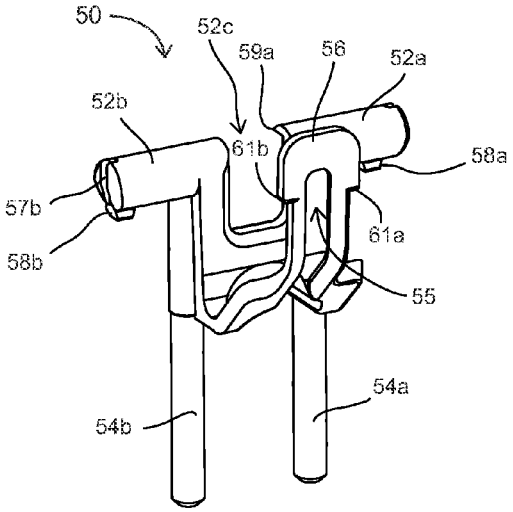
FIG. 7C is a rear perspective view of the uncocked spring element.

FIG. 7C is a rear perspective view of spring 50 in the uncocked position. In a preferred embodiment, tongue 56 has shoulders 61*a* and 61*b*. Shoulders 61*a* and 61*b* act with overhangs 59*a* and 59*b* in order to hold tongue 56 in the proper cocked position. Overhangs 59*a* and 59*b* are simply the result of substantially rectangular grooves on the interior lateral portions of arms 52*a* and 52*b*. The tops of the rectangular grooves are preferably angled upwards away from tongue 56 (best shown in FIGS. 7G and 7H) to fine tune the angle of the bend in tongue 56 when in the cocked position. However, tongue 56 may be held into the cocked position by the underside of lid 30 when attached to lid 30 without the presence of shoulders 61*a* and 61*b* and with overhangs 59*a* and 59*b*.

Figure 7D:
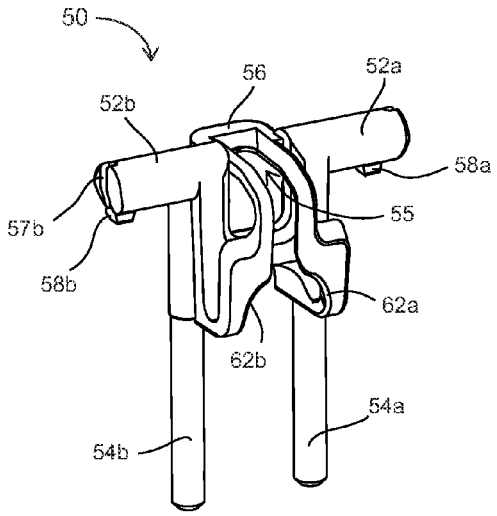
FIG. 7D is a rear perspective view of the cocked spring element.

FIG. 7D is a rear perspective view of spring 50 in the cocked position. Curved surfaces 62*a* and 62*b* at the base of tongue 56 are to accommodate nozzle 72 (shown in FIG. 6) on actuator 70 (also shown in FIG. 6).

Figure 7E:
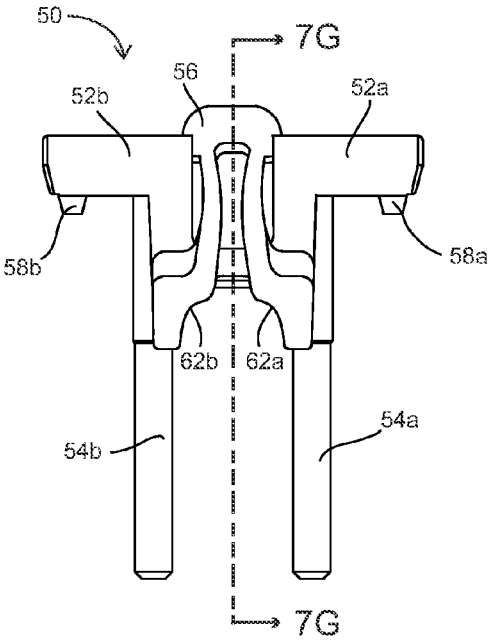
FIG. 7E is a rear view of the cocked spring element shown in FIG. 6.
Figure 7F:
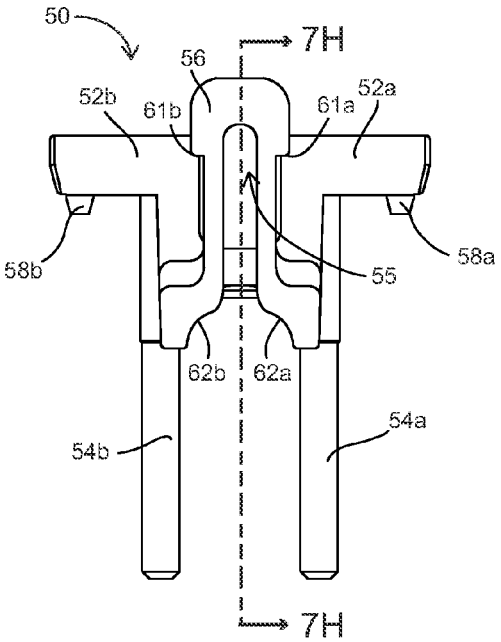
FIG. 7F is a rear view of the uncocked spring element shown in FIG. 6.

FIG. 7E is a rear view of the cocked spring element shown in FIG. 6, and FIG. 7F is a rear view of the uncocked spring element shown in FIG. 6

Figure 7G:
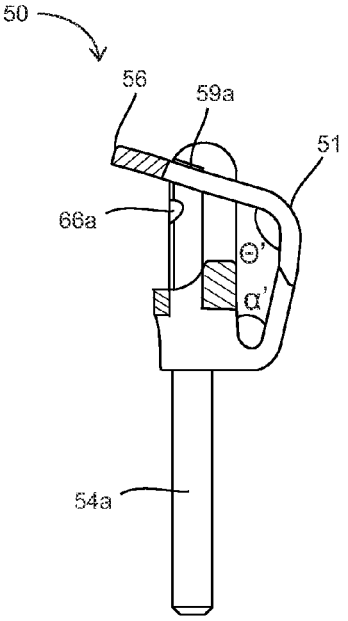
FIG. 7G is a cross-sectional view of the cocked spring element taken generally along line 7G-7G in FIG. 7E.

FIG. 7G is a cross-sectional view of the cocked spring element taken generally along line 7G-7G in FIG. 7E. Angle $\alpha'$ is the cocked angle between the base of spring 50 and leg 54*a*, and angle $\theta'$ is the cocked bend angle of bend 51 in the shaft of tongue 56. Both cocked angles $\alpha'$ and $\theta'$ are smaller than the uncocked angles $\alpha$ and $\theta$ (shown in FIG. 7H), which generates tension in the material making up tongue 56 and thereby priming tongue 56 to provide a biasing torque. The tension in bend 51 provides most of the biasing torque for the spring action.

Figure 7H:
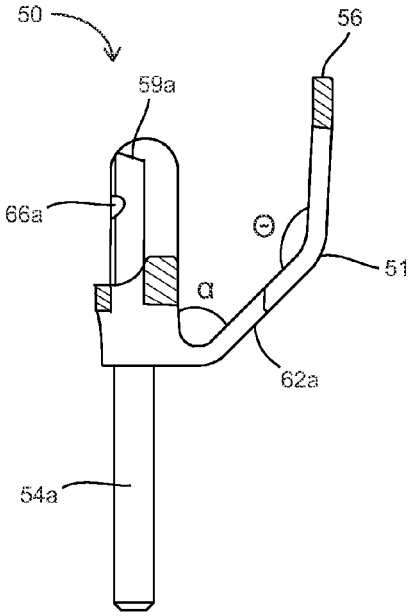
FIG. 7H is a cross-sectional view of the cocked spring element taken generally along line 7H-7H in FIG. 7F.

FIG. 7H is a cross-sectional view of the cocked spring element taken generally along line 7H-7H in FIG. 7F. In FIG. 7H, angle $\alpha$ is the uncocked angle between the base of spring 50 having curved surface 62*a* and leg 54*a*. Angle $\theta$ is the uncocked bend angle of bend 51 in the shaft of tongue 56. The top of the substantially rectangular groove of overhang 59*a* is shown angled upwards away from tongue 56 to fine tune the angle of the bend in tongue 56 when in the cocked position.

Figure 8:
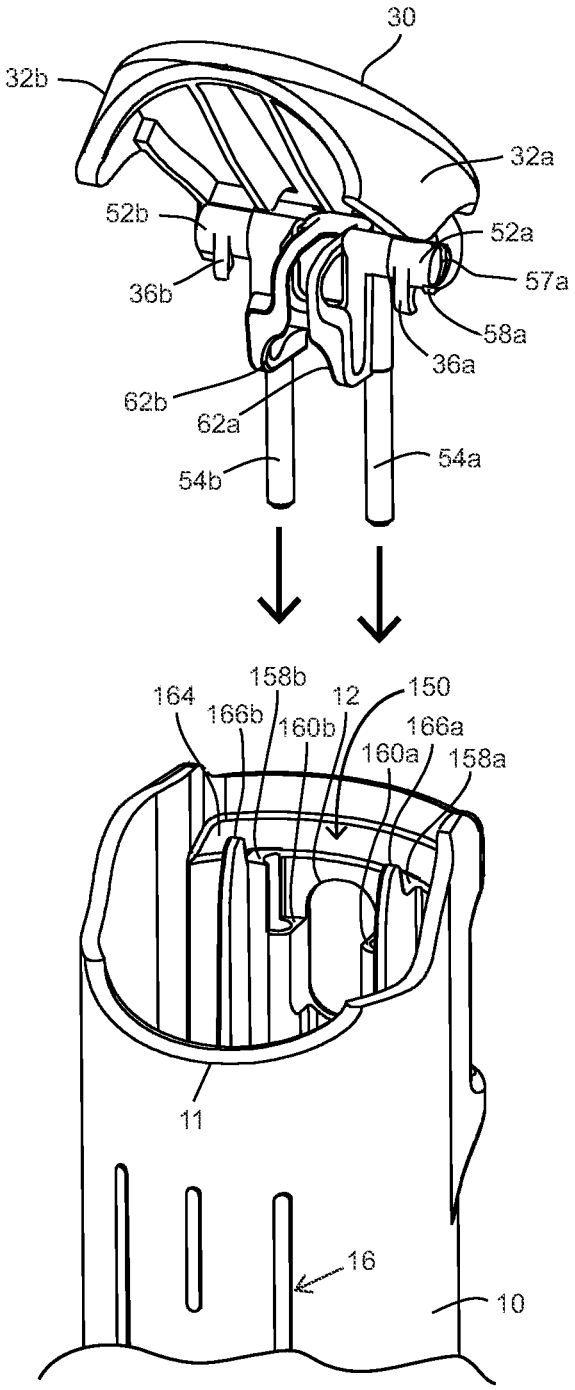
FIG. 8 is a rear view of the body illustrating the engagement mechanism.

FIG. 8 illustrates lid 30 attached to a cocked spring 50, and engagement mechanism 150 of main body 10. With respect to spring 50, tongue 56 (shown in FIGS. 7A-7H) is angled toward the front of main body 10, and legs 54*a* and 54*b* are inserted axially downwards proximal to the front of main body 10.

Engagement mechanism 150 has a symmetrical set of elements starting with partial through bores (shown as bores 156*a* and 156*b* in FIG. 9A) in flat platforms 160*a* and 160*b* to snugly receive spring leg 54*a* and 54*b*, respectively. Flat platforms 158*a* and 158*b* extend axially upwards from platforms 160*a* and 160*b* and contain semicircle partial through bores with the lateral interior semicircles unbound by platforms 160*a* and 160*b*. The diameter of the partial through bores in platforms 160*a* and 160*b* are slightly larger than the diameters of the partial through bores in platforms 158*a* and 158*b*. The slightly larger diameters facilitate the insertion of spring legs Ma and 54*b* into the partial through bores of platforms 160*a* and 160*b* by acting as guides and decreasing the precision required for assembly. Apices 166*a* and 166*b* extend radially inward and axially upwards from platforms 158*a* and 158*b*, respectively, and act as mechanical stops to tabs 36*a* and 36*b*, respectively, on lid 30. Engagement mechanism 150 also has curved surface 164 extending radially inward and sloping axially downward from the front of main body 10. Curved surface 164 is described in more detail with respect to FIGS. 13A and 13B below.

Figure 9A:
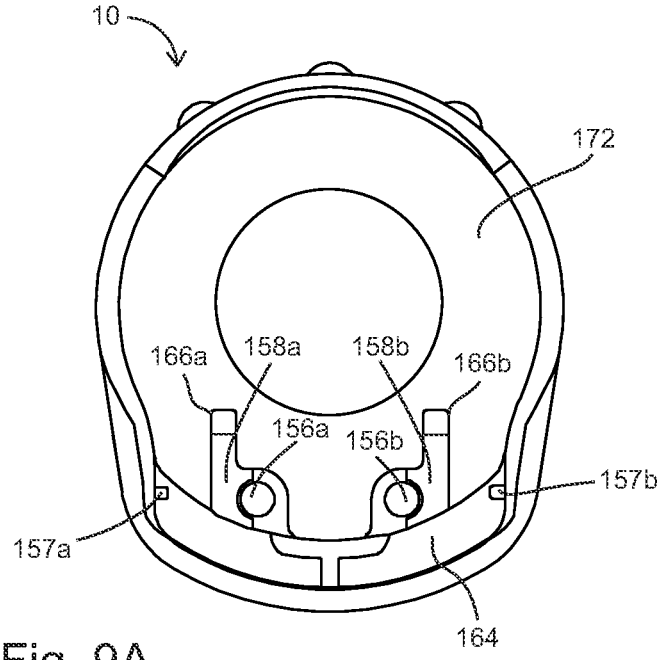
FIG. 9A is a top view of the main body.

FIG. 9A is a top view of main body 10. Lateral rails 157*a* and 157*b* extend into the interior of main body 10 and extend axially downward to curved surface 164. As was explained above, arm slot 57*b* (shown in FIGS. 7A-7H) and its analog on spring 50 engages rail 157*b* and 157*a*, respectively, to ensure that spring 50 is properly inserted into main body 10 as well as provide stability to spring arms 52*a* and 52*b* while lid 30 (shown in FIG. 2) is rotating. Partial through-bores 156*a* and 156*b* are shown with a slightly smaller diameter than the partial through bores of platforms 158*a* and 158*b*, respectively. Apices 166*a* and 166*b* extend radially inward from platforms 158*a* and 158*b*, respectively. Main body 10 also has shelf 172 extending radially inward, which will be explained in further detail with respect to FIG. 12B.

Figure 9B:
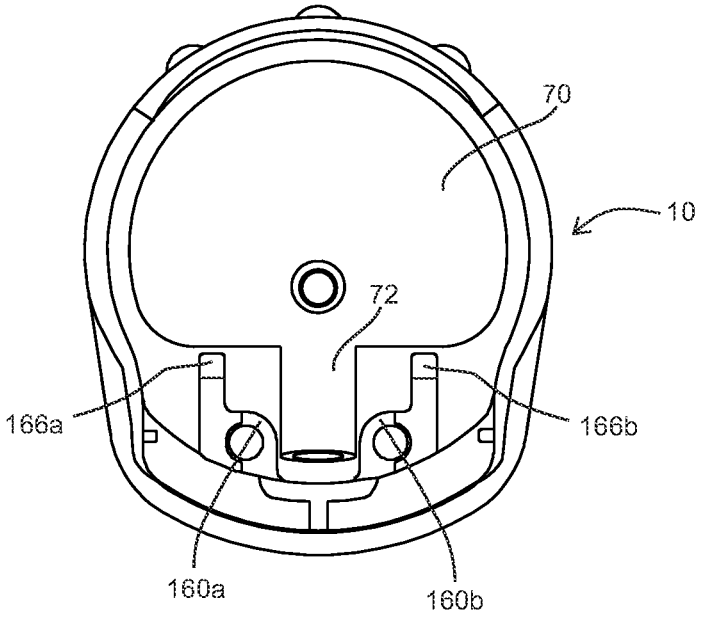
FIG. 9B is a top view of the main body with the actuator in place.

FIG. 9B is a top view of main body 10 housing actuator 70. Nozzle 72 is shown to sit between platforms 160*a* and 160*b* and does not extend radially beyond main body 10. Apices 166*a* and 166*b* extend radially inward to at least partially constrain any radial movement of actuator 70.

Figure 10:
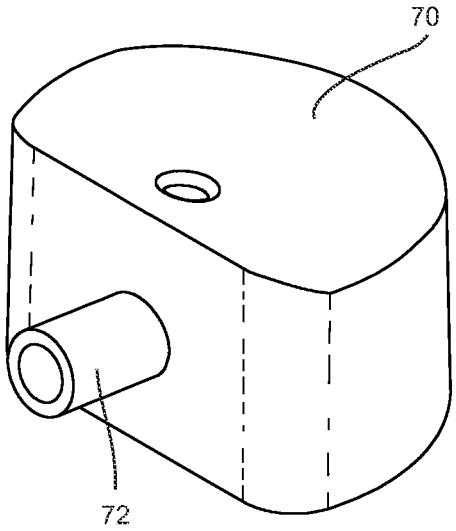
FIG. 10 is a perspective view of the actuator.

FIG. 10 is a front perspective view of actuator 70 with its nozzle 72.

Figure 11:
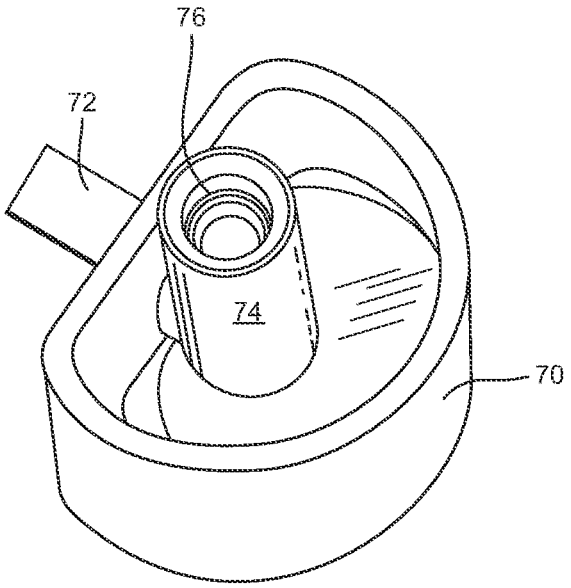
FIG. 11 is a perspective bottom view of the actuator.

FIG. 11 is a bottom rear perspective view of actuator 70 with its nozzle 72. Actuator 70 engages the canister with receiving port 74 and the substance contained within canister is dispelled through bore 76 within receiving port 74 and redirected through nozzle 72.

Figure 12A:
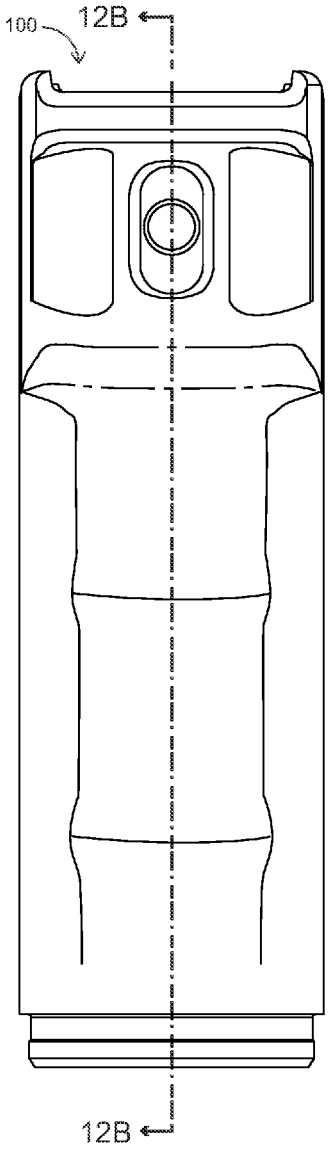
FIG. 12A is a front view of the main body with the lid and bottom cap removed.
Figure 12B:
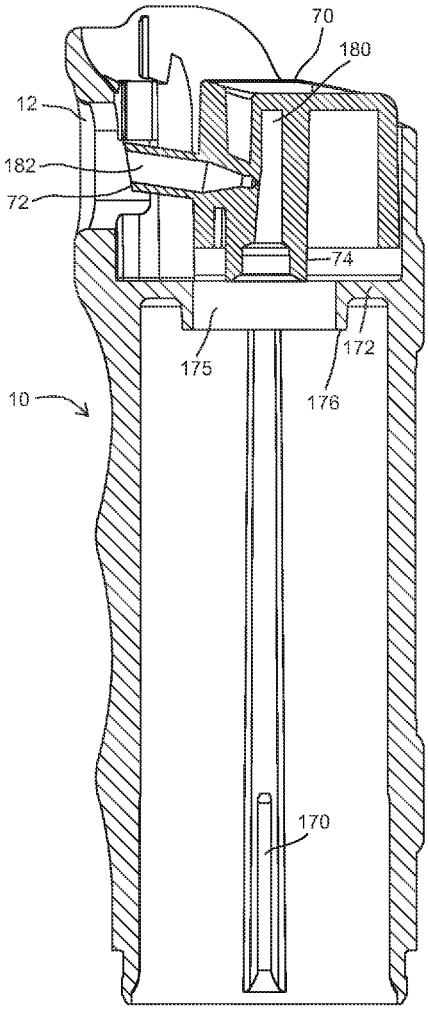
FIG. 12B is a cross-sectional view of the main body taken generally along line 12B-12B in FIG. 12A.

FIG. 12A is a front view of the main body with the lid and bottom cap removed. FIG. 12B is a cross-sectional view of the main body taken generally along line 12B-12B in FIG. 12A. Shelf 172 extends radially inward from main body 10 and has an interior circumferential surface 175. Circumferential surface 175 has a greater axial length than shelf 172 and extends from the top radial surface of shelf 172 axially downward. Bottom surface 176 rests on top of the canister (not shown). The stem of the canister extends axially upward through shelf 172 and engages receiving port 74 of nozzle 70. When actuator 70 is depressed, the contents of the canister are dispelled through the canister stem and axially upward into duct 180. The only outlet for the contents of the canister is into channel 182 of nozzle 72, thereby directing the contents out of main body 10 through aperture 12.

Main body 10 also has internal axial ridges (ridge 170 is shown) that extend radially inward to at least partially constrain any radial movement of the canister. The internal axial ridges, such as ridge 170, accommodate any radial expansion or contraction of the canister throughout its use by allowing the canister to expand in the gaps between the ridge without puncturing the canister and without compromising stability between main body 10 and the canister. In a preferred embodiment, four internal axial ridges are used, but as few as zero may be used and as many may be used without compromising the pressure within the canister.

Figure 13A:
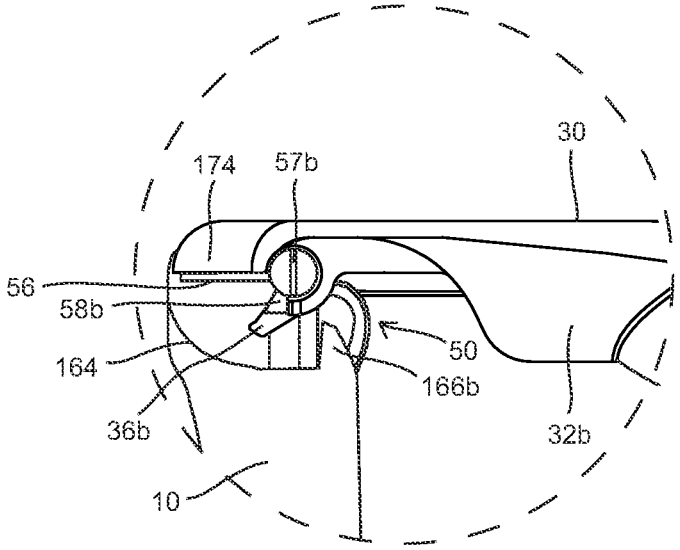
FIG. 13A is an enlarged fragmentary lateral view of the lid, spring and body engagement mechanisms in a resting position.

FIG. 13A is a magnified view of spring 50 connecting lid 30 and main body 10 in a closed position. Front edge 174 and tongue 56 are shown to be substantially horizontal, which is an angular difference from the sloped top of the substantially rectangular grooves of overhang 59*a* shown in FIGS. 7G and 7H. By situating tongue 56 horizontally, tongue 56 is now loaded against front edge 174 and provides a biasing torque to front edge 174 of lid 30 (forcing edge 174 in a generally upwards direction) causing lid 30 to be in the closed position. When in the closed position, interfaces 24*a* (shown in FIG. 3 as between lid wing 32*a* and main body 10) and 24*b* (not shown) act as the mechanical stop to the rotation of lid 30. So, like the cocked position of spring 50, the closed position of lid 30 generates a loaded static state for spring 50.

Figure 13B:
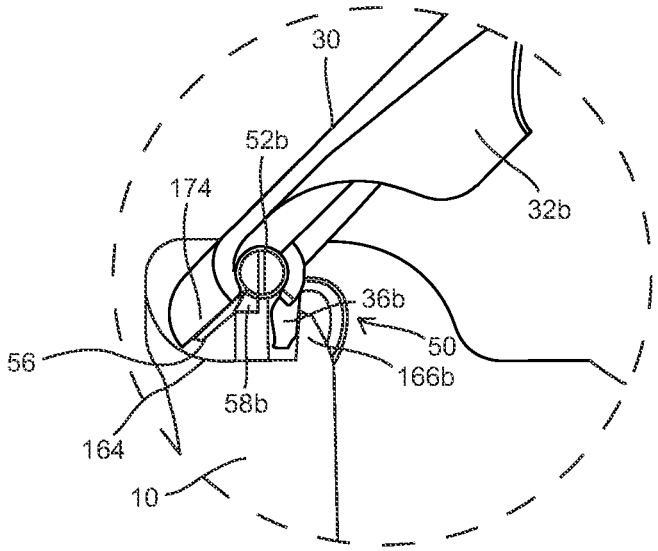
FIG. 13B is an enlarged fragmentary lateral view of the lid, spring and body engagement mechanisms in a loaded position; and, FIG. 14 is a perspective view of the bottom cap.

FIG. 13B is a magnified view of spring 50 connecting lid 30 and main body 10 while in the maximum open position. To get to the maximum open position, the user inserts his or her thumb under lid 30 causing lid 30 to rotate around arm 52*b*. Tongue 56 is pushed in a generally downwards direction causing spring 50 to become loaded against front edge 174. Curved surface 164 enables front edge 174 to swing down into main body 10. Bend angle θ' of bend 51 (shown in FIG. 7G) decreases, which increases the tension in tongue 56. Increasing or decreasing the bend angle of bend 51 is considered to be dynamic as opposed to static. The maximum open position is also considered dynamic because elements of case 100 (shown in FIG. 2) do not self-sustain tongue 56 in a position without intervention of the user.

The counter-clockwise rotation of lid 30 in FIG. 13B is prohibited by various mechanical engagements. Lid 30 is prohibited from further rotation with respect to spring 50 by the abutment of front edge 174 on spring tab 58*b*. Lid 30 is also prohibited from further rotation with respect to spring 50 by the engagement described above with reference to FIGS. 7A-7H where front edge 174 abuts front spring grooves 166*a* and 166*b*. In FIG. 13B, lid 30 is prohibited from further rotation with respect to main body 10 by the abutment of lid tab 36*b* with apex 166*b*. Also, spring 50 is securely fixed to main body 10 through engagement mechanism 150 (shown in FIG. 8) interacting with spring legs 54*a* and 54*b* (shown in FIGS. 7A-7H), and lateral rails 157*a* and 157*b* (shown in FIG. 9B) interacting with arm slots 57*a* and 57*b* (shown in FIGS. 7A-7H).

Figure 14:
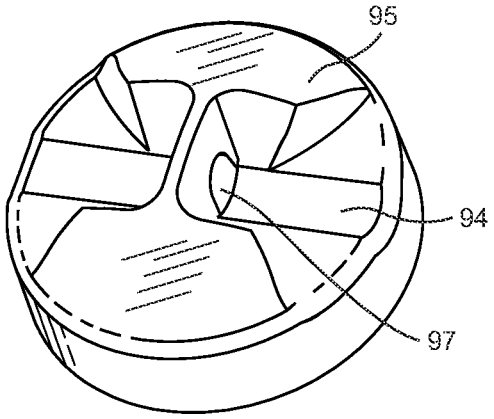

FIG. 14 is a bottom perspective view of bottom cap 95. Bottom cap 95 has radial aperture 97 so that case 100 (shown in FIG. 2) can be attached to a key ring or chain or a string. Groove 94 enables a multitude of attachment accessories such as the key ring, etc., to fit through aperture 97.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention as claimed.

LIST OF REFERENCE NUMBERS

10 Body
12 Circumferential aperture
13 Indents
14 Finger ridge
15 Finger ridge
16 Grips
20 Rear opening
24 Lid-Body rear interface
30 Lid
32 Lateral lid wings
34 Sloped guides
35 Horizontal guides
36 Lid tabs
38 Lid curved receptacles
41 Circumferential lip
50 Spring
52 Arms
54 Legs
56 Tongue
57 Lateral slits
58 Arm tabs
59 Overhangs
61 Tongue tabs
62 Tongue curve
64 Tongue base curve
66 Leg groove
68 Leg larger diameter interface
70 Actuator
72 Nozzle
74 Receiving port
76 Bore
95 Bottom cap
96 Circumferential lip
100 Case
150 Body engagement mechanism
154*s* Support bases
156*s* Partial through-bores
157 Lateral guides
158 Level 1 of partial through bore
160 Level 2 of partial through bore
162 Semicircle partial through bore
164 Curved internal body surface
166 Apices
168 Lateral guides label
170 Body internal ridges
172 Body shelf
174 Front edge of lid

What is claimed is:

1. A spring mechanism, comprising:
a tapered flexible tongue with an enlarged tip and a pair of shoulders extending from the tip;
a spring element having a pair of arms separated by a gap having a pair of overhangs operatively arranged to act as a mechanical stop for said pair of shoulders prohibiting said tongue from rotating out of said gap; and,
a tapered slot extending longitudinally through the tongue,
wherein said tapered flexible tongue is operatively arranged to bend such that said tip enters said gap and engages said pair of arms.

2. The spring mechanism recited in claim 1, wherein said tongue has a base integral with the arms, the base having a curved inner surface.

3. The spring mechanism recited in claim 2, wherein the slot extends into the tip and the base, and the curved surface and the slot create a continuous inner surface.

4. The spring mechanism recited in claim 1, wherein said tongue is made of plastic.

5. The spring mechanism recited in claim 1, wherein said tongue has a bend traversing said slot.

6. The spring mechanism recited in claim 1, wherein said tapered slot is hollow.

7. A spring mechanism, comprising:
a spring element having a pair of arms separated by a gap;
a tapered flexible tongue with an enlarged tip; and,
a hollow tapered slot extending longitudinally through the tongue,
wherein said tapered flexible tongue is operatively arranged to bend such that said tip enters said gap and engages said pair of arms.

8. The spring mechanism of claim 7, wherein the tongue has a base integral with the arms, the base having a curved inner surface.

9. The spring mechanism of claim 8, wherein the slot extends into the tip and the base, and the curved surface and the slot create a continuous inner surface.

10. A spring mechanism, comprising:
a spring element having a pair of arms separated by a gap;
a tapered flexible tongue with an enlarged tip; and,
a tapered slot extending longitudinally through the tongue, wherein said tapered flexible tongue is operatively arranged to bend such that said tip enters said gap and engages said pair of arms.

11. The spring mechanism recited in claim 10, wherein said tongue is made of plastic.

12. The spring mechanism recited in claim 10, wherein said tongue has a bend traversing said slot.

13. The spring mechanism recited in claim 10, wherein said tongue has a pair of shoulders and said gap has a pair of overhangs operatively arranged to act as a mechanical stop for said pair of shoulders prohibiting said tongue from rotating out of said gap.

* * * * *